US009011033B2

(12) United States Patent
Orubor

(10) Patent No.: US 9,011,033 B2
(45) Date of Patent: Apr. 21, 2015

(54) COMBINED HAND HELD SURFACE CLEANING AND POWERED SPRAY DEVICE

(76) Inventor: Lawrence Orubor, Calgary (CA)

( * ) Notice: Subject to any disclaimer, the term of this patent is extended or adjusted under 35 U.S.C. 154(b) by 526 days.

(21) Appl. No.: 13/190,350

(22) Filed: Jul. 25, 2011

(65) Prior Publication Data

US 2012/0079668 A1 Apr. 5, 2012

Related U.S. Application Data

(60) Provisional application No. 61/369,170, filed on Jul. 30, 2010.

(51) Int. Cl.

| | |
|---|---|
| ***B43K 5/02*** | (2006.01) |
| ***B08B 1/00*** | (2006.01) |
| ***A47L 1/06*** | (2006.01) |
| ***A47L 1/08*** | (2006.01) |

(52) U.S. Cl.
CPC ... *B08B 1/00* (2013.01); *A47L 1/06* (2013.01); *A47L 1/08* (2013.01)

(58) Field of Classification Search
USPC ..... 401/188 R, 136–140; 15/104.93–104.94, 105, 121, 321, 401; 239/375
See application file for complete search history.

(56) References Cited

U.S. PATENT DOCUMENTS

| | | | | |
|---|---|---|---|---|
| 3,458,265 | A * | 7/1969 | Andrini | 401/139 |
| 4,349,039 | A * | 9/1982 | Egger | 134/167 C |
| 5,782,991 | A * | 7/1998 | van der Heyden et al. | 134/37 |
| 6,010,267 | A * | 1/2000 | Vito | 401/138 |
| 6,722,806 | B2 * | 4/2004 | Kunkler et al. | 401/138 |
| 7,004,658 | B2 * | 2/2006 | Hall et al. | 401/140 |
| 7,163,349 | B2 * | 1/2007 | Policicchio et al. | 401/137 |
| 7,708,485 | B2 * | 5/2010 | Tanaka et al. | 401/138 |
| 8,069,520 | B2 * | 12/2011 | Mattucci et al. | 15/4 |
| 8,109,685 | B1 * | 2/2012 | Vito | 401/188 R |
| 8,347,443 | B1 * | 1/2013 | Conrad | 15/24 |
| 2004/0146333 | A1 * | 7/2004 | Fu | 401/25 |
| 2004/0223803 | A1 * | 11/2004 | Fahy et al. | 401/190 |
| 2004/0237228 | A1 * | 12/2004 | King et al. | 15/50.1 |
| 2009/0097902 | A1 * | 4/2009 | Lemmon | 401/140 |

* cited by examiner

*Primary Examiner* — David Walczak
*Assistant Examiner* — Jennifer C Chiang
(74) *Attorney, Agent, or Firm* — Maxey Law Offices, PLLC; Stephen Lewellyn

(57) ABSTRACT

A powered, spray cleaning device that can be operated in an inverted orientation is provided. The cleaning device includes a cleaning head and an elongated handle configured to be grasped by a user. A container of cleaning solution is removably received by the handle, and when received by the handle, fluid from the container fills a fluid accumulator. Fluid in the fluid accumulator is prevented from flowing back into the container when the device is inverted, thus allowing the device to spray fluid when inverted.

33 Claims, 20 Drawing Sheets

COMBINED HAND HELD SURFACE CLEANING AND POWERED SPRAY DEVICE

CROSS-REFERENCE TO RELATED APPLICATIONS

This application claims the benefit of U.S. Provisional Application No. 61/301,267, filed Feb. 4, 2010, the entirety of which is incorporated herein by reference.

FIELD OF THE INVENTION

The present invention relates generally to cleaning implements, and more particularly, relating to a window and glass cleaning apparatus including the automated dispensing of a cleaning fluid and including several embodiments of cleaning heads having multiple cleaning implement arrangements, and including several accessory attachments.

BACKGROUND OF THE INVENTION

Cleaning windows and glass can be a time consuming and laborious choir. There exists numerous cleaning devices and squeegee blades of a myriad of constructions directed towards reducing the effort and time required to clean windows and glass. However, there remains a need for a window and glass cleaning apparatus of an improved construct which overcomes the drawbacks of the existing cleaning devices.

SUMMARY OF THE INVENTION

The preferred embodiments of the present invention addresses this need by providing a window and glass cleaning apparatus of an improved construction and including the automated dispensing of a cleaning fluid, several cleaning head configurations, and accessory attachments.

In general, in one aspect, hand held surface cleaning and powered spray device is provided. The device includes a cleaning head and an elongated handle configured to be grasped by a user. The handle has a first end connected to the cleaning head and a second end configured to be connected to an extension handle. The handle is further configured to removably receive and retain a container in fixed relation to the handle. A spray nozzle is carried by the handle at a position approximate the first end thereof. A fluid accumulator is housed by the handle and is adapted to be fluidically connected to a container received and retained by the handle to receive a quantity of fluid contained by the container in a single flow direction from the container to the fluid accumulator. An electric pump carried by the handle is connected to the fluid accumulator and the spray nozzle and operates to pump fluid from the fluid accumulator and through the spray nozzle. A power source and an electric switch are carried by the handle. The electric switch is operatively connected to the power source and the electric pump and is operable to connect the power source and the electric motor.

In general, in another aspect, the device includes extension handle is provided and is connectable to the second end of the handle. A secondary electric switch is carried by the extension handle and is operatively connected to the power source and the electric motor when the extension handle is connected to the second end of the handle. The secondary electric switch operable to connect the power source and the electric pump.

In general, in another aspect, the device includes a cleaning head and an extension tube connected to the cleaning head and an elongated handle configured to be grasped by a user. The handle has a first end through which extends a tubular cavity and into which the extension tube is telescopically received for positioning between retracted and extended positions. The handle further has a second end configured to be connected to an extension handle and is further configured to removably receive and retain a container in fixed relation to the handle. A spray nozzle is carried by the handle at a position approximate the first end thereof. A fluid accumulator is housed by the handle and is adapted to be fluidically connected to a container received and retained by the handle to receive a quantity of fluid contained by the container in a single flow direction from the container to the fluid accumulator. An electric pump carried by the handle is connected to the fluid accumulator and the spray nozzle and operates to pump fluid from the fluid accumulator and through the spray nozzle. A power source and an electric switch are carried by the handle. The electric switch is operatively connected to the power source and the electric pump and is operable to connect the power source and the electric motor.

Numerous objects, features and advantages of the present invention will be readily apparent to those of ordinary skill in the art upon a reading of the following detailed description of presently preferred, but nonetheless illustrative, embodiments of the present invention when taken in conjunction with the accompanying drawings. The invention is capable of other embodiments and of being practiced and carried out in various ways. Also, it is to be understood that the phraseology and terminology employed herein are for the purpose of descriptions and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

For a better understanding of the invention, its operating advantages and the specific objects attained by its uses, reference should be had to the accompanying drawings and descriptive matter in which there are illustrated preferred embodiments of the invention.

BRIEF DESCRIPTION OF THE DRAWINGS

The accompanying drawings, which are included to provide further understanding of the invention and are incorporated in and constitute a part of this specification, illustrate preferred embodiments of the invention and together with the description serve to explain the principles of the invention, in which.

DETAILED DESCRIPTION OF THE INVENTION

Figure 1:
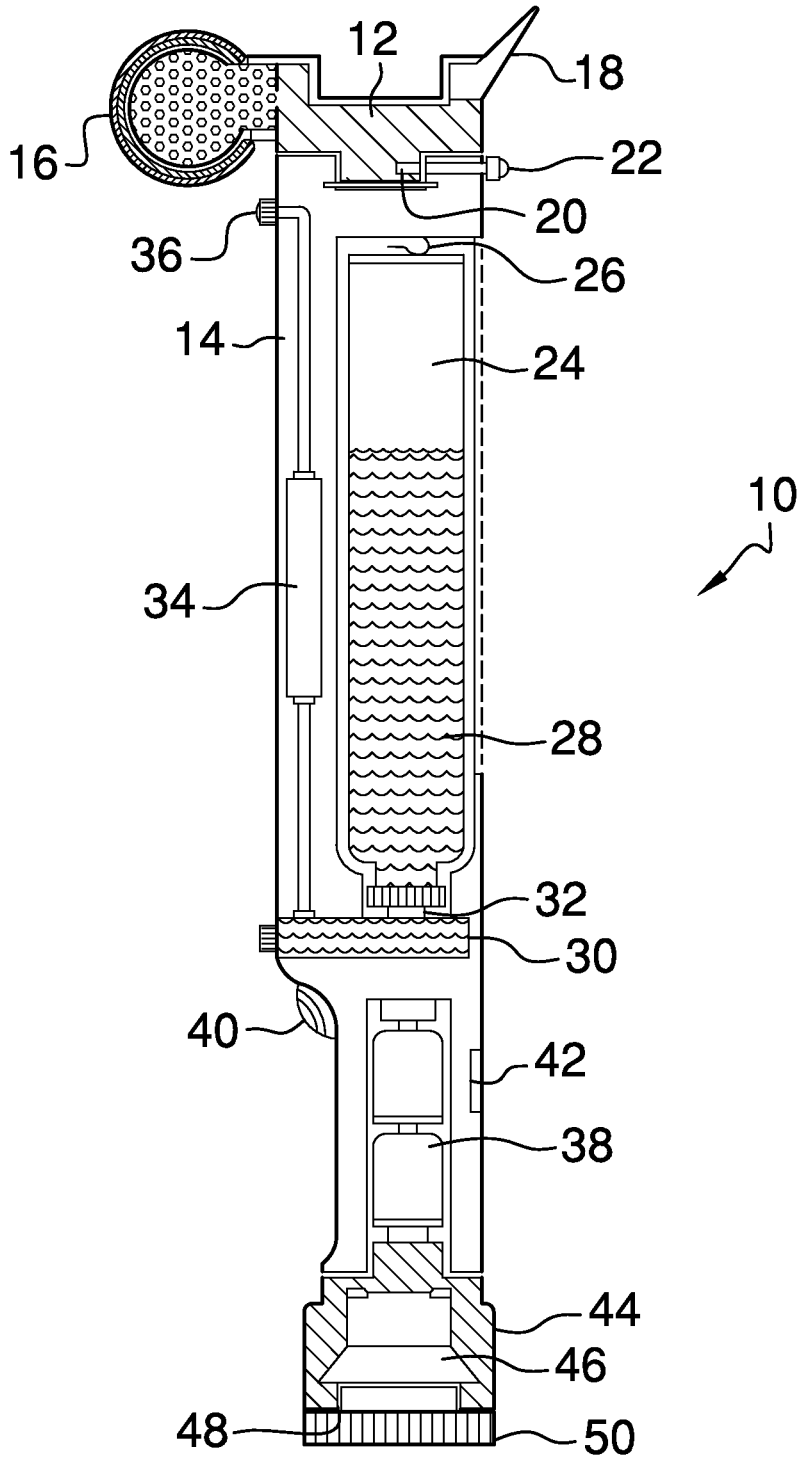
FIG. 1 is a diagrammatic illustration of a combined surface cleaning and powered spray device constructed in accordance with the principles of the present invention.
Figure 2:
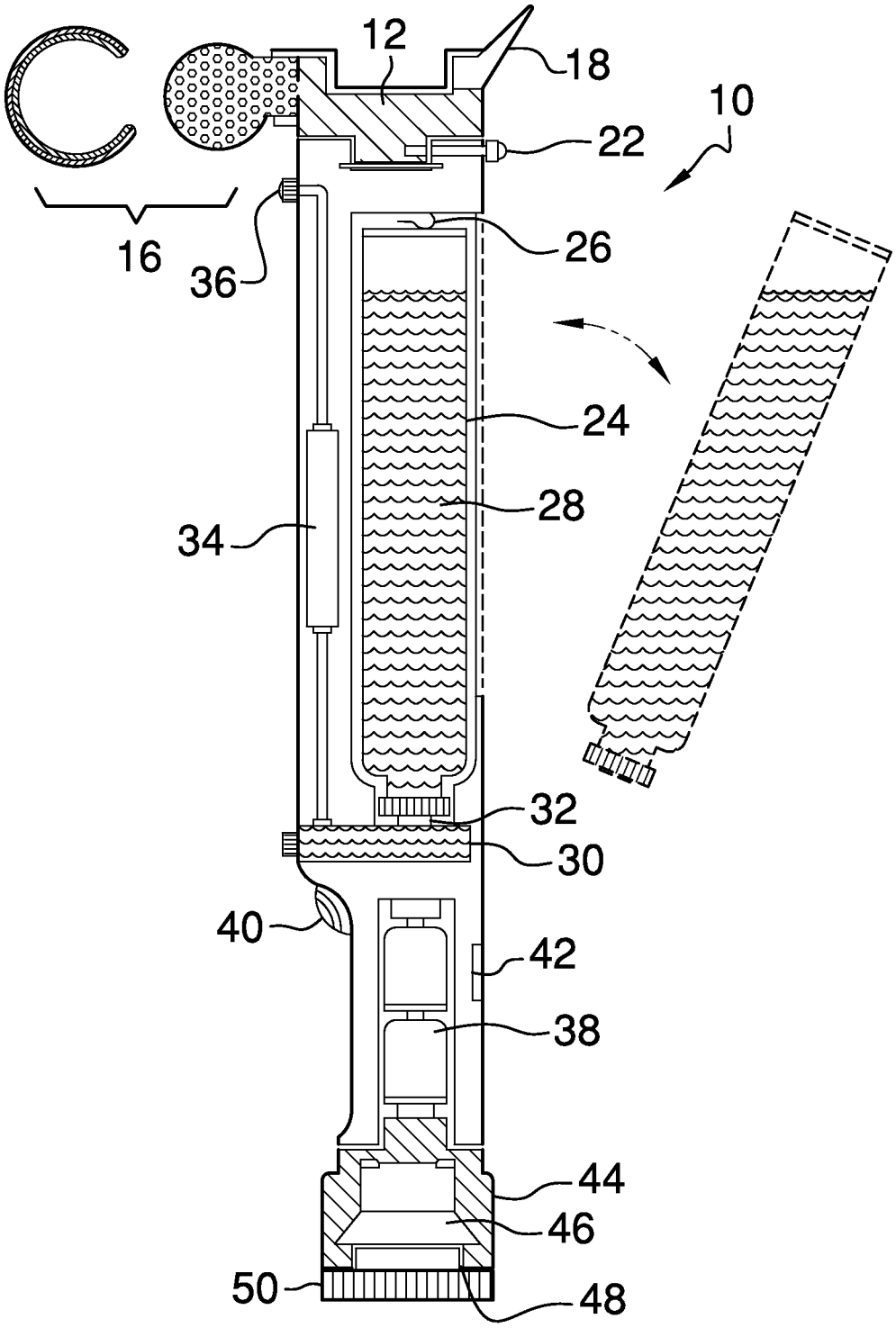
FIG. 2 is a diagrammatic illustration of the device of FIG. 1 showing a container removed.

Diagrammatically illustrated in FIGS. 1 and 2 is a specially designed hand held surface cleaning and powered spray device 10 particularly useful in cleaning hard surfaces of homes and automobiles, such as, but not limited to window surfaces and the like. The device 10 includes a cleaning head 12 attached to a handle 14. The cleaning head 12 may include a cleaning member 16, such as, but not limited to an absorbent material, an abrasive material, or the like that is adapted to contact and clean a hard surface. The cleaning member 16 may include a replaceable pad as best seen in FIG. 2. The cleaning head 12 may further include a squeegee blade 18. The cleaning head 12 may be pivotally connected to the handle 14 by pivot coupling 20 such that the cleaning head 12 may pivot between first and second positions relative to the handle 14. In the first position, the cleaning head 12 is generally normal to the handle 14 in a T-configuration, and in the second position, the cleaning head 12 is generally parallel to the handle 14. A lock 22 may operate to secure the cleaning head 12 in either of the first and second positions.

A container 24 containing a cleaning solution 28 is removably received and held within handle 14 through a cooperating structure between the handle and the container. Spring element 26 is biased against one end of the container 24 to secure the container within handle 14. Container 24 is shown received and held by the handle 14 in FIG. 1, and removed from the handle in FIG. 2. A quantity of cleaning solution 28 is held within container 24 for dispensing through a powered spray assembly onto a surface to be cleaned by device 10. The container 24 is fluidically connected to an accumulator 30 for receiving cleaning solution 28 when the container is received and held by handle 14. Container 24 may include a thin membrane seal that is punctured by a needle like device disposed on handle 14 for fluidically connecting in a fluid tight connection the interior of the container with the accumulator 30 to receive the clean solution 28. Alternative structures to the membrane seal may be utilized in fluidically connecting the container 24 to the accumulator 30. Further a check valve 32 may be positioned across the connection between the container 24 and the accumulator to prevent cleaning solution 28 that has flown into the accumulator 30 to reverse flow into the container, as will be described in more detail below.

A fluid pumping device 34 is fluidically connected to the accumulator 30 and a spray nozzle 36, and is operated to pump cleaning solution 28 from the accumulator through spray nozzle 36. Fluid pumping device or electric pump 34 is electrically operated and is electrically connected to an electric power source 38, such as batteries. An electric switch 40 in the form of a finger operated push button controls the flow of power from the batteries 38 to the fluid pumping device 34. A safety switch 42 may be provided and operated to override electric switch 40 to prevent inadvertent spraying of the cleaning solution 28. Spray nozzle 36 may be adjustable control the stream pattern flowing therefrom, e.g. from a wide spray pattern to a narrow stream pattern.

Figure 3:
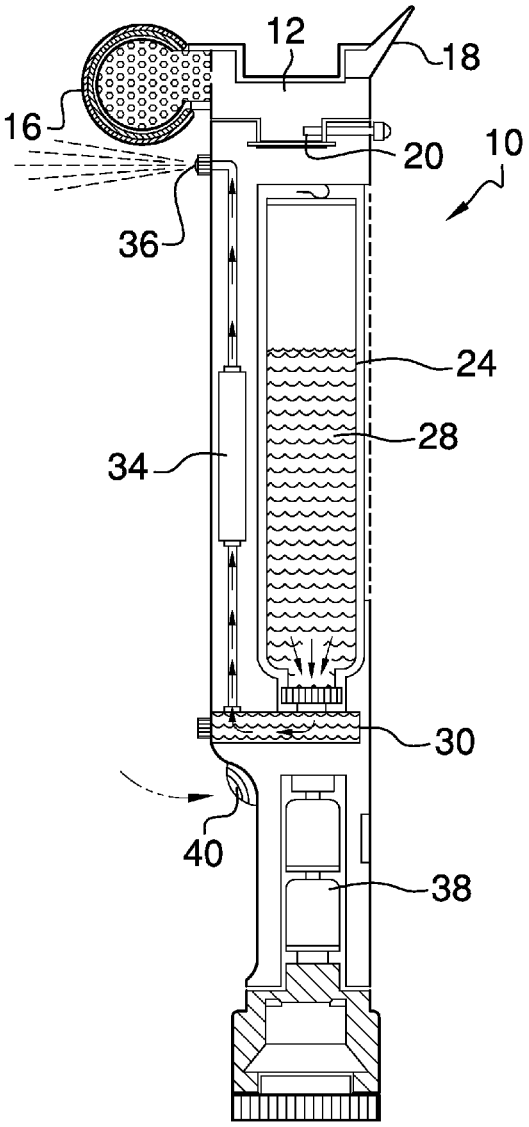
FIG. 3 is a diagrammatic illustration of the device of FIG. 1 in use in a generally upright vertical orientation.

In FIG. 3, there is diagrammatically shown, the device 10 in use in an upright generally vertical configuration wherein the accumulator 30 is positioned below the container 24 such that cleaning solution is free to flow under the force of gravity into the accumulator.

Figure 4:
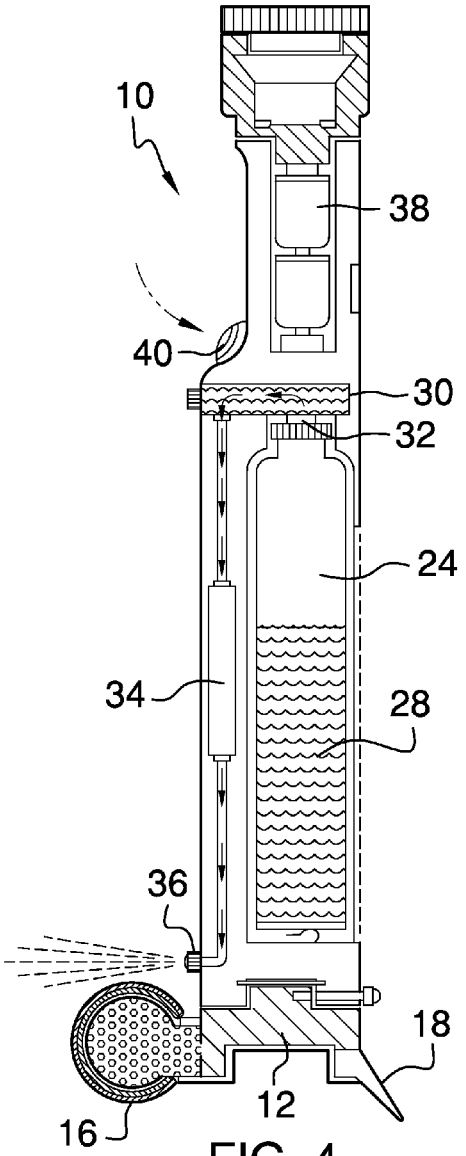
FIG. 4 is a diagrammatic illustration of the device of FIG. 1 in use in a generally inverted vertical orientation.

In FIG. 4, there is diagrammatically shown, the device 10 in use in an inverted generally vertical configuration wherein the accumulator 30 is positioned above the container 24. In this configuration, the check valve 32 prevents cleaning solution 28 within the accumulator from flowing into the container, and provides a momentary supply of cleaning solution to the pump 34 to be dispensed through nozzle 36. As generally shown in FIGS. 3 and 4, the device is capable of dispensing a cleaning solution, for at least a limited period of time, when position in any orientation.

With continued reference to FIGS. 1 and 2, an end portion 44 is removably attached to the bottom of handle 14, for example through a cooperative threaded engagement, to permit access to power supply or batteries 38 for replacement. End portion 44 permits the attachment of accessories to the handle 14 and includes a socket 46 that is cooperatively engagable to an accessory permitting the connection to handle. Access to the socket 46 is made through opening 48 formed through an end of the end portion 36. Opening 48 is selectively closed by a cap 50 that is threadable into the opening 48.

Figure 5:
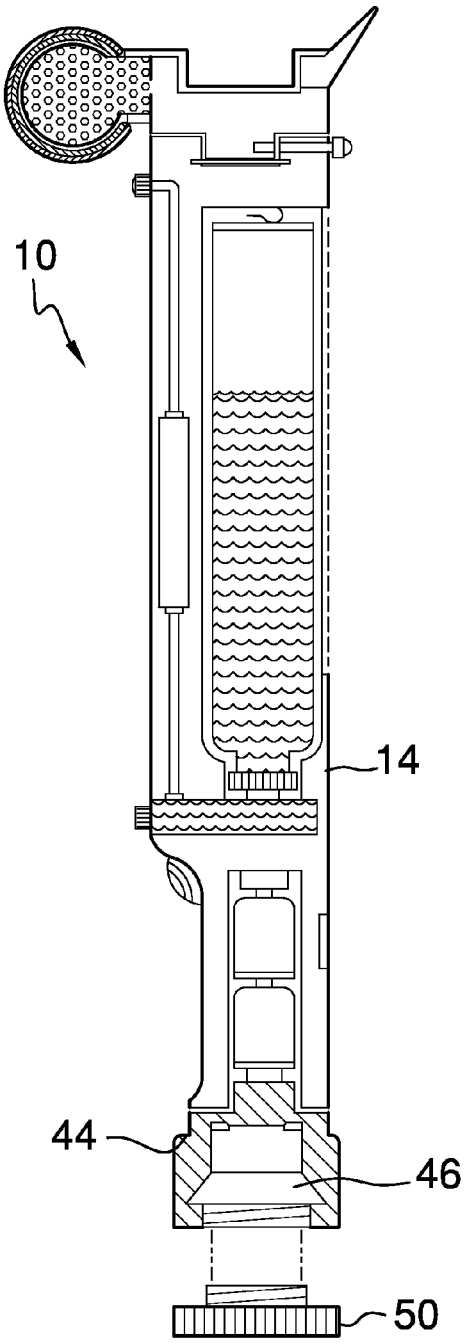
FIG. 5 is a diagrammatic illustration of the device of FIG. 1 partially exploded.

In FIG. 5, there is diagrammatically shown, the device 10 having the cap 50 removed from the end portion 44, and thereby providing access to the socket 46 for the attachment of an extension handle 52 (FIG. 6) to extend the reach of handle 14.

Figure 6:
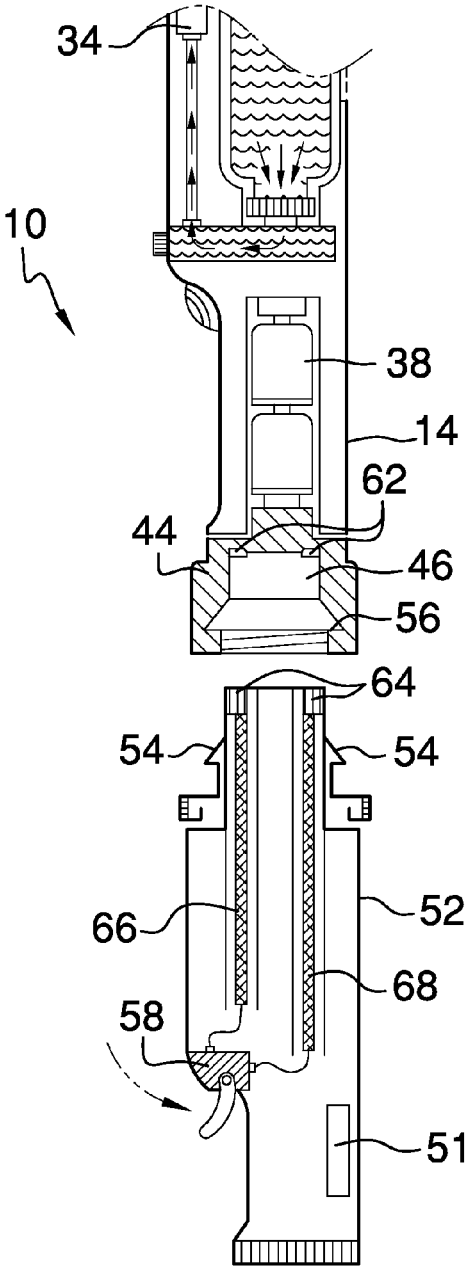
FIG. 6 is a diagrammatic illustration of the device of FIG. 1 an embodiment of an extension handle.

In FIG. 6, there is diagrammatically shown, the device 10 and an embodiment of an extension handle 52 for connection to socket 46 of handle 14. Extension handle 52 is shown exploded from handle 14. An end of the extension handle 52 and the socket 46 are configured for cooperative engagement to permit fixedly connecting the extension handle to handle 14. In an aspect, the extension handle 52 can include spring biased tabs 54 that are cooperatively engagable with shoulder 56 of the socket 46. In this instance, the end of the extension handle 52 is inserted through opening 48 and into the socket 46 which causes tabs 54 to be pressed inwardly towards the extension handle. Once the extension handle 52 is fully inserted into the socket 46 of the end portion 44, the tabs 54 engage shoulder 56 and lock the end of the extension handle within the socket, and thereby connect the extension handle to the handle 14. Other structures capable of fixedly connecting the extension handle 52 or accessories to handle 14 could also be employed.

Figure 31:
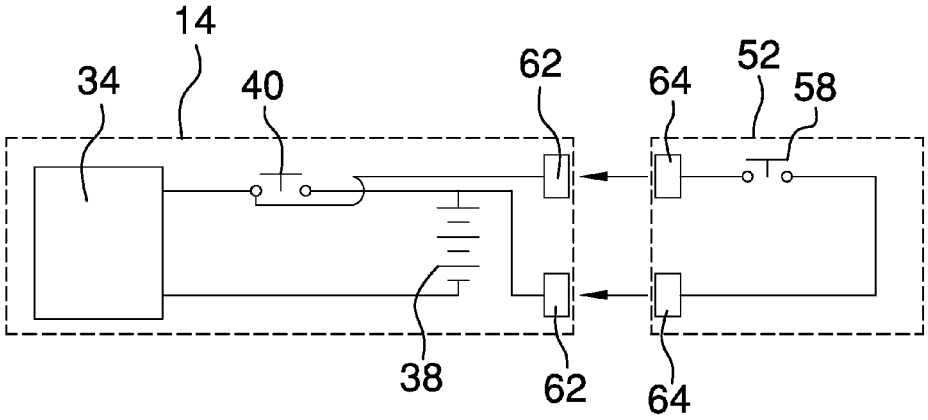
FIG. 31 is an electrical diagram in accordance with an embodiment of the invention.

The extension handle 52 includes a secondary electrical switch 58 that is electrically connected to the power source 38 and pump 34 by a cooperative electrical connection that is made when the extension handle 52 is connected to handle 14. The cooperative electrical connection includes a pair of electrical contacts each including an electrical contact pad 62 positioned within the socket 46 and an electrical contact pad 64 positioned on the extension handle 52. Contact pads 62 and 64 of each electrical connection are arranged such that they are engaged and communicate electrical power when the extension handle 52 is connected to handle 14. The secondary electrical switch 58 is connected to contact pads 64 of each of the electrical connection by associated wiring 66 and 68. Likewise, contact pads 62 of each of the electrical connection are connected to the power supply 38 and the pump 34 by associated wiring as best seen in FIG. 31. In this configuration operation of switch 58 operates the pump 34, thereby dispensing cleaning solution 28 through nozzle 36. Extension handle 52 may include an optional secondary power supply 51, as illustrated.

Figure 7:
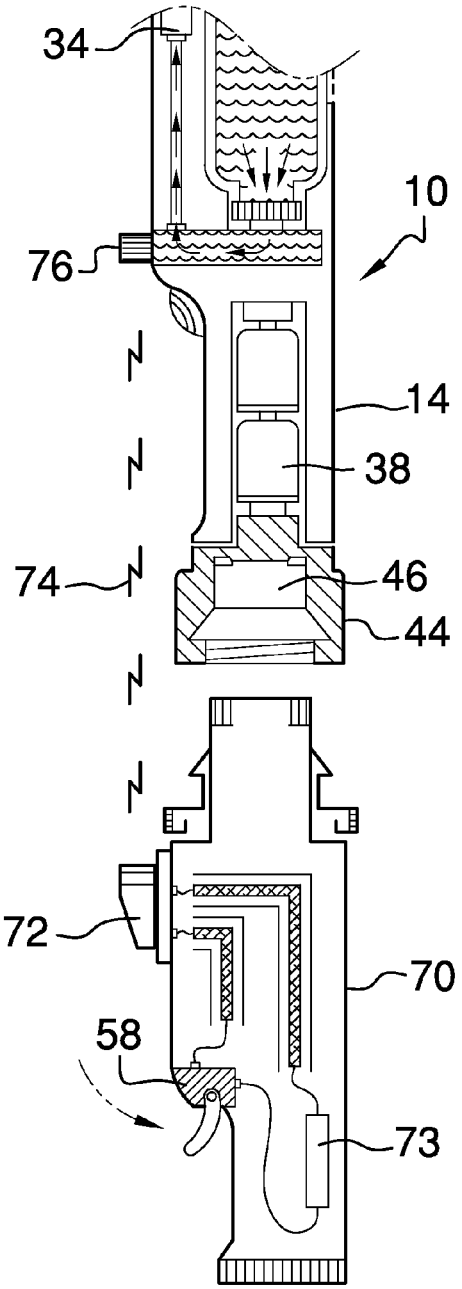
FIG. 7 is a diagrammatic illustration of the device of FIG. 1 an other embodiment of an extension handle.
Figure 32:
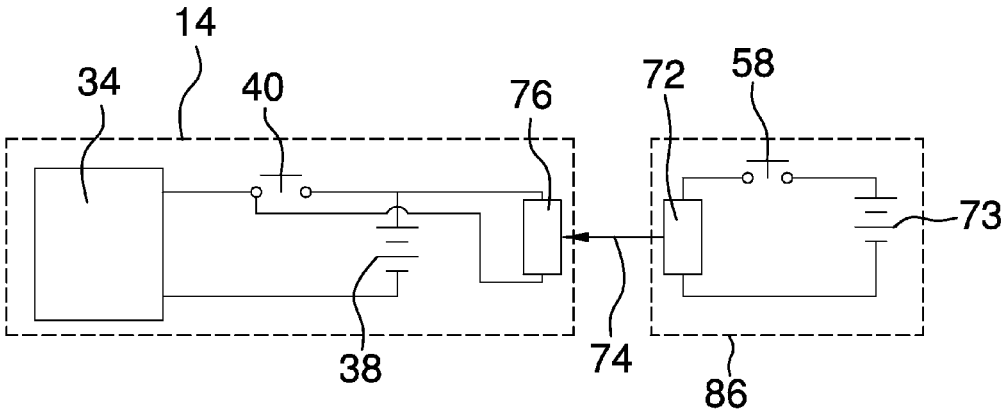
FIG. 32 is an electrical diagram in accordance with an embodiment of the invention.

In FIG. 7, there is diagrammatically shown, the device 10 and an alternative embodiment of an extension handle 70 for connection to socket 46 of handle 14. Here, extension handle 70 includes a wireless transmitter 72 which is configured to send a control signal 74 to a wireless receiver 76 at handle 14. The wireless receiver 76 is configured to receive the control signal 74 and to establish the flow of power from the power source 38 to the pump 34. Secondary switch 58 electrically connects the wireless transmitter 72 to power source 73 to operate the wireless transmitter to send the control signal 74 as best seen in FIG. 32.

Figure 8:
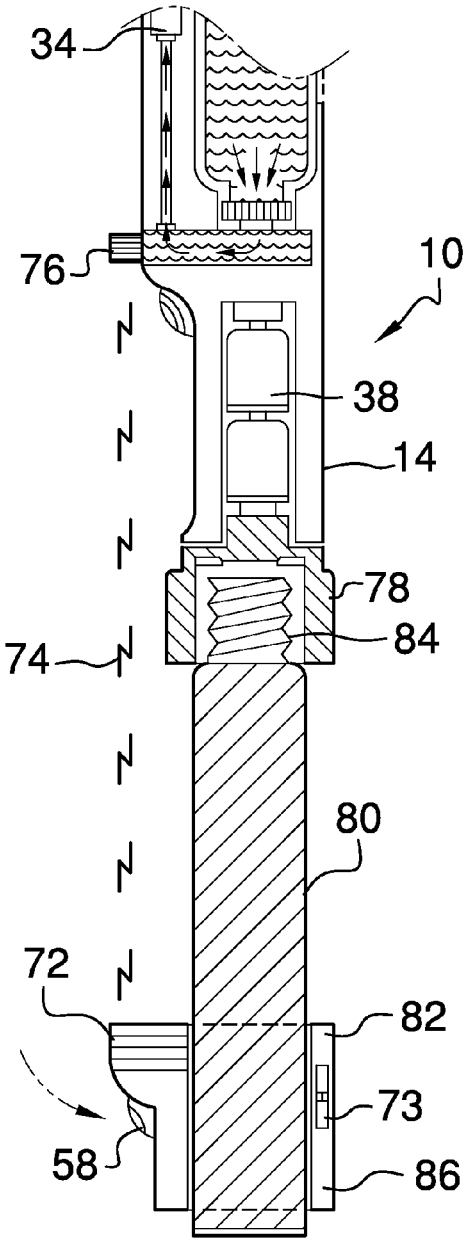
FIG. 8 is a diagrammatic illustration of the device of FIG. 1 an other embodiment of an extension handle.

In FIG. 8, there is diagrammatically shown the device 10, an alternative embodiment of an end portion 78, an alternative embodiment of an extension handle 80, and an alternative wireless transmitter assembly 82. Here, end portion 78 includes a threaded socket 84 adapted to threadably receive a conventional extension handle having a threaded end, such as an extension handle typically used to extend the reach of a paint roller. Transmitter assembly 82 comprised a band 86 that is removably attached to extension handle 80 and contains the wireless transmitter 72, power source 73, and secondary switch 58 as described above with respect to FIG. 7.

It is important to note, the end of extension handle 52 and 70 as in FIGS. 6 and 7, respectively, could be threaded. This way, the extension handles can then be threadably received by threaded socket 84 that is adapted to threadably receive a conventional extension handle having a threaded end, thereby eliminating the need of multiple socket attachments. Such as the end portion of 44 having a socket 46 in FIG. 6 and FIG. 7, respectively.

Figure 9:
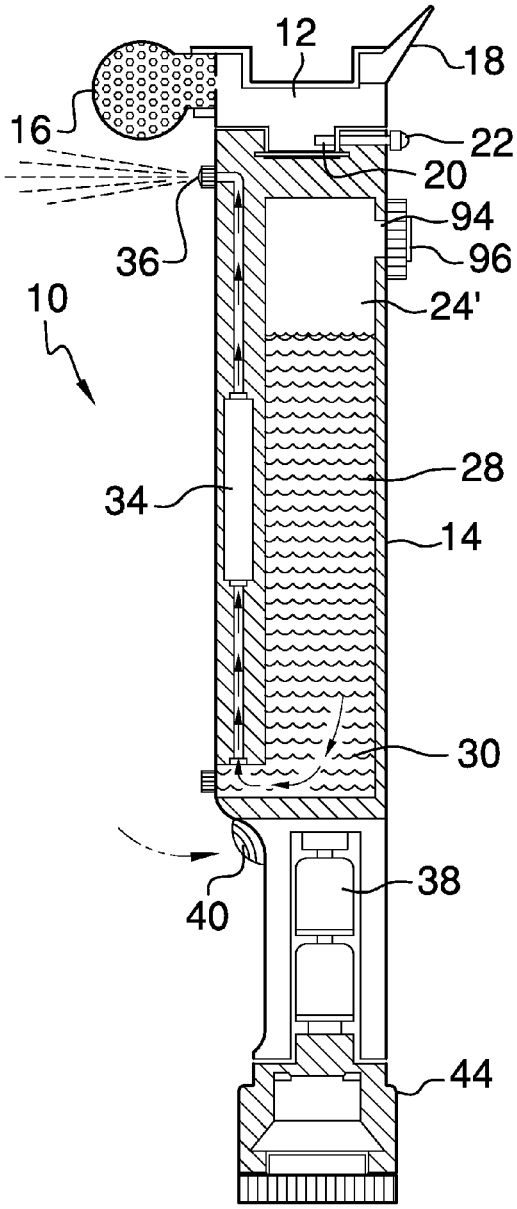
FIG. 9 is a diagrammatic illustration of the device of FIG. 1 having an alternative construction.

In FIG. 9, there is diagrammatically shown an alternative construction of the device 10. Here, the device 10 includes a fixed or integrated container 24' that is not removable from the handle 14. Container 24' and the accumulator 30 can be integrated, as shown. Container 24' includes a mouth or opening 94 having a removable cover 96 permitting filing of the container 24' with a cleaning solution 28. Opening 94 may be funnel-shaped to permit easy filling.

Figure 10:
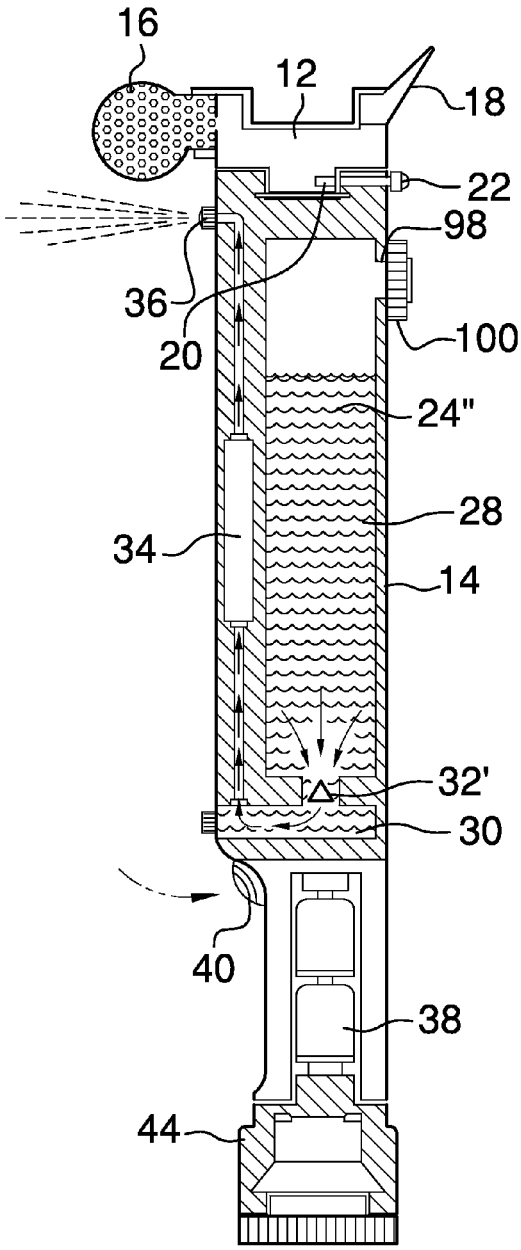
FIG. 10 is a diagrammatic illustration of the device of FIG. 1 having an alternative construction.

In FIG. 10, there is diagrammatically shown an alternative construction of the device 10. Here, the device 10 includes a fixed or integrated container 24" that is not removable from the handle. Container 24" is fluidically connected to the accumulator 30 via check valve 32'. Container 24" includes a mouth or opening 98 having a removable cover 100 permitting filling of the container 24" with a cleaning solution. Opening 98 may be funnel-shaped to permit easy filling.

Figure 11:
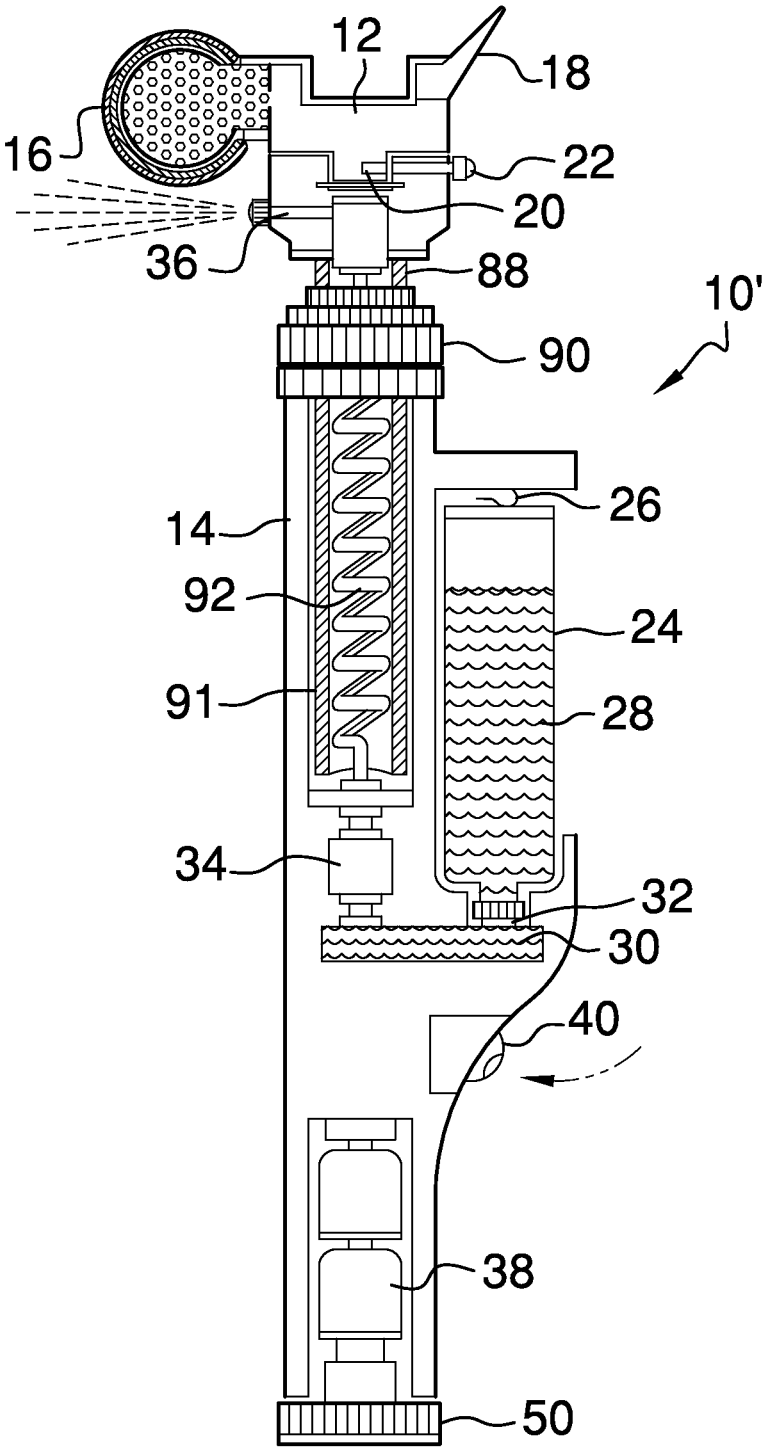
FIG. 11 is a diagrammatic illustration of the device of FIG. 1 having yet another an alternative construction including an extension tube shown in a refracted position.
Figure 12:
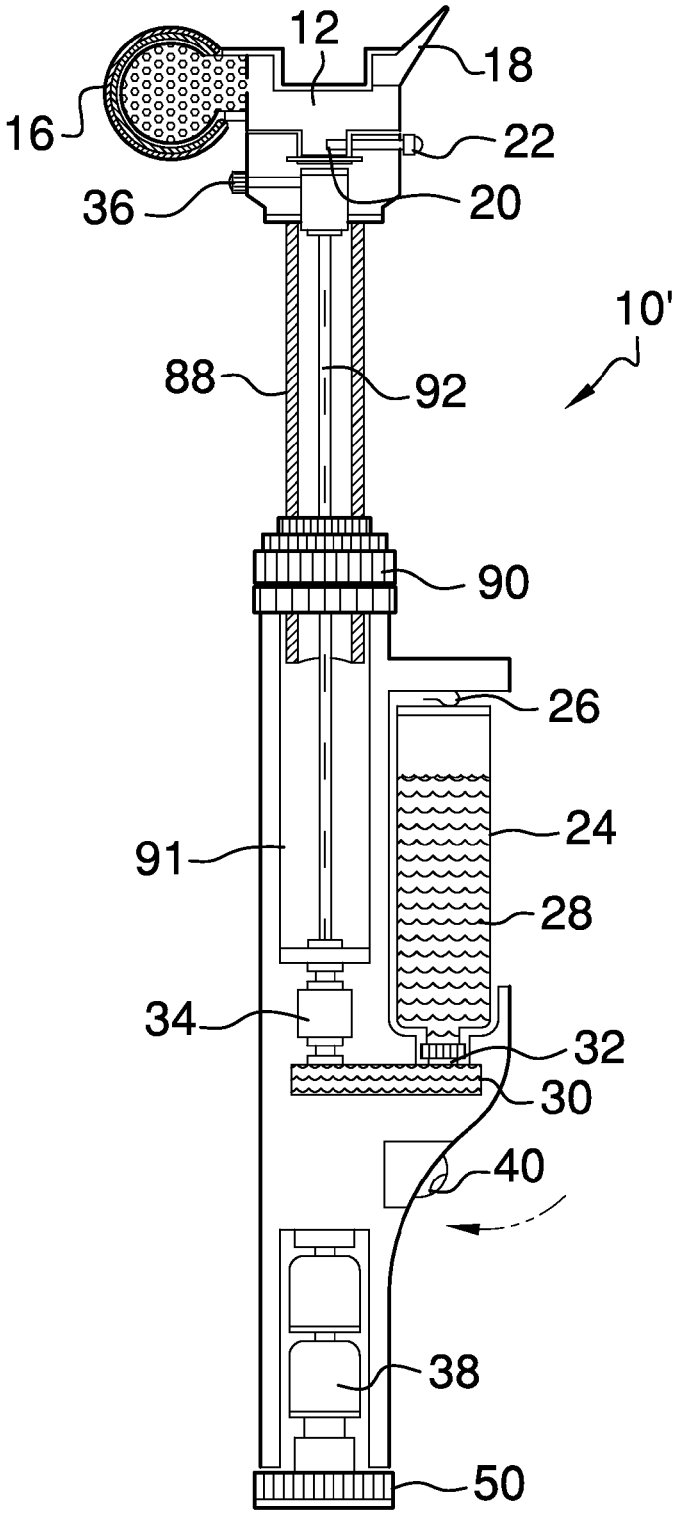
FIG. 12 is a diagrammatic illustration of the device of FIG. 11 with the extension tube shown in an extended position.

In FIGS. 11 and 12, there is diagrammatically shown, an alternative construction of the device 10. Here, device 10' has cleaning head 12 secured to an extension tube 88 that is telescopically received by tubular cavity 91 within handle 14. Cleaning head 12 is secured to the extension tube 88 as in device 10 of FIGS. 1 and 2. The extension tube 88 shown in the retracted position in FIG. 11, and in the extended position in FIG. 12. A tubular locking nut 90 operates to secure the extension tube 88 at any extension length between the fully retracted position of FIG. 11 and the fully extended position of FIG. 12. A coiled tubing 92 extends internally through extension tube 88 and fluidically connects the pump 34 to the spray nozzle 36.

Figure 13:
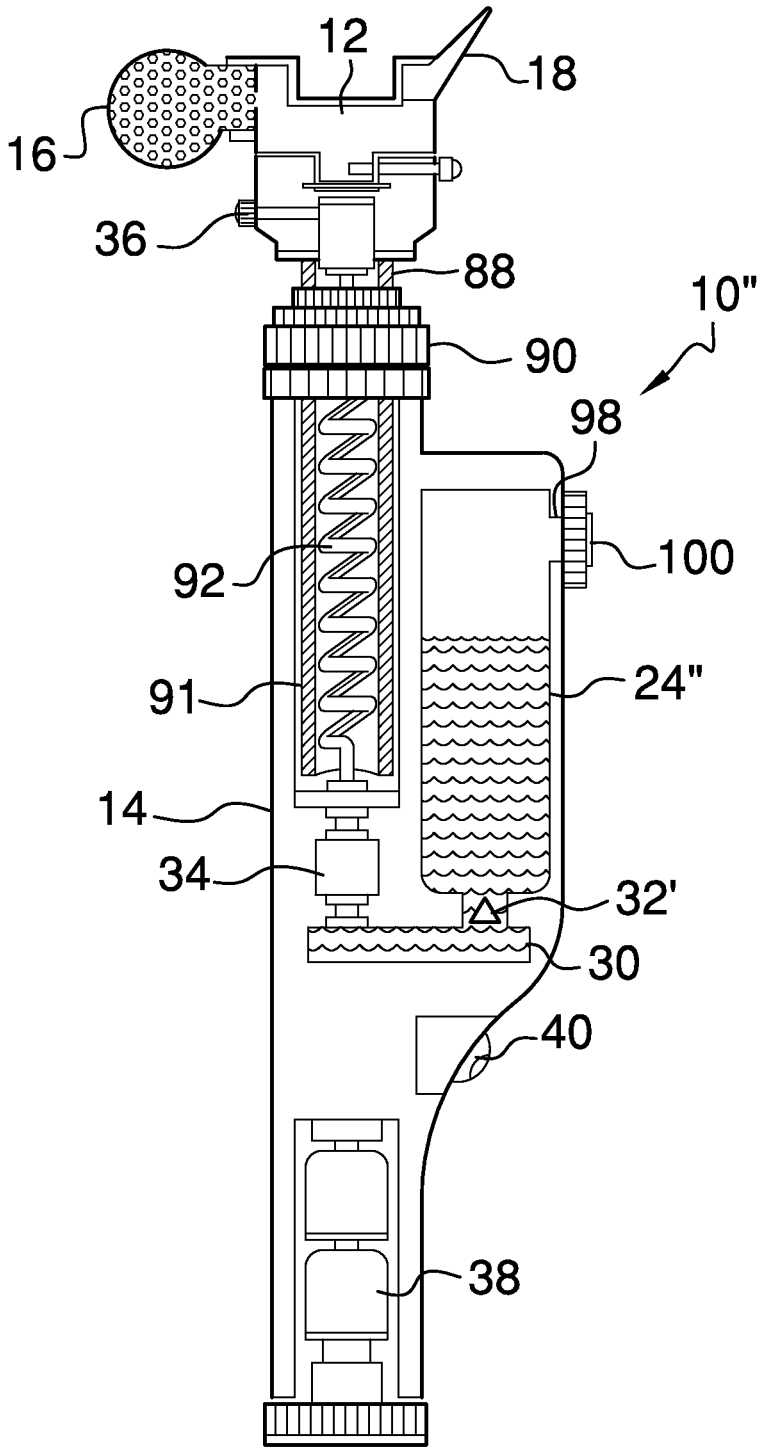
FIG. 13 is a diagrammatic illustration of the device of FIG. 11 having yet another an alternative construction.

In FIG. 13, there is diagrammatically shown yet another alternative construction of the device 10, wherein like reference numbers refer to the same parts. Here, device 10" is a combination of the constructions of the device of FIGS. 10-12.

Figure 14:
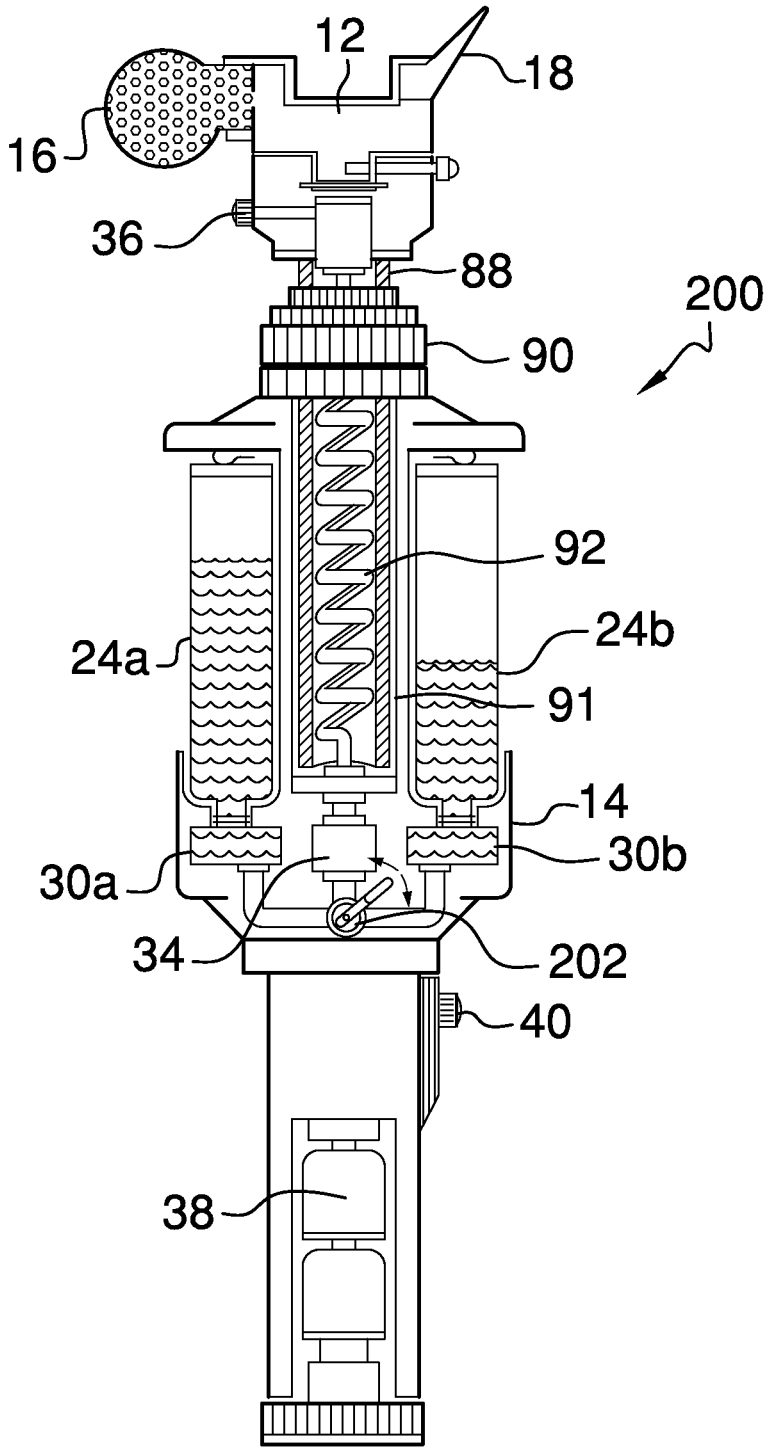
FIG. 14 is a diagrammatic illustration of the device of FIG. 1 having yet another an alternative construction including a dual removable container arrangement.

In FIG. 14, there is diagrammatically shown yet another alternative construction of the device 10, wherein like reference numbers refer to the same parts. Here, device 200 comprises essentially any of the alternative constructions of device 10 described herein, but in a dual construction wherein device 200 includes two containers **24*a* and 24*b* each separately received and retained by handle 14 to be in fluidic communication with accumulators 30*a* and 30*b*, respectively. Accumulators 30*a* and 30*b*, are selectively fluidically connected to pump 34 by selector valve 202. As shown, device 200 comprises the extension tube 88 construction of FIGS. 11 and 12, but could also include the fixed construction of FIG. 1, and also can include the extension handle embodiments of FIGS. 6-8**.

Figure 15:
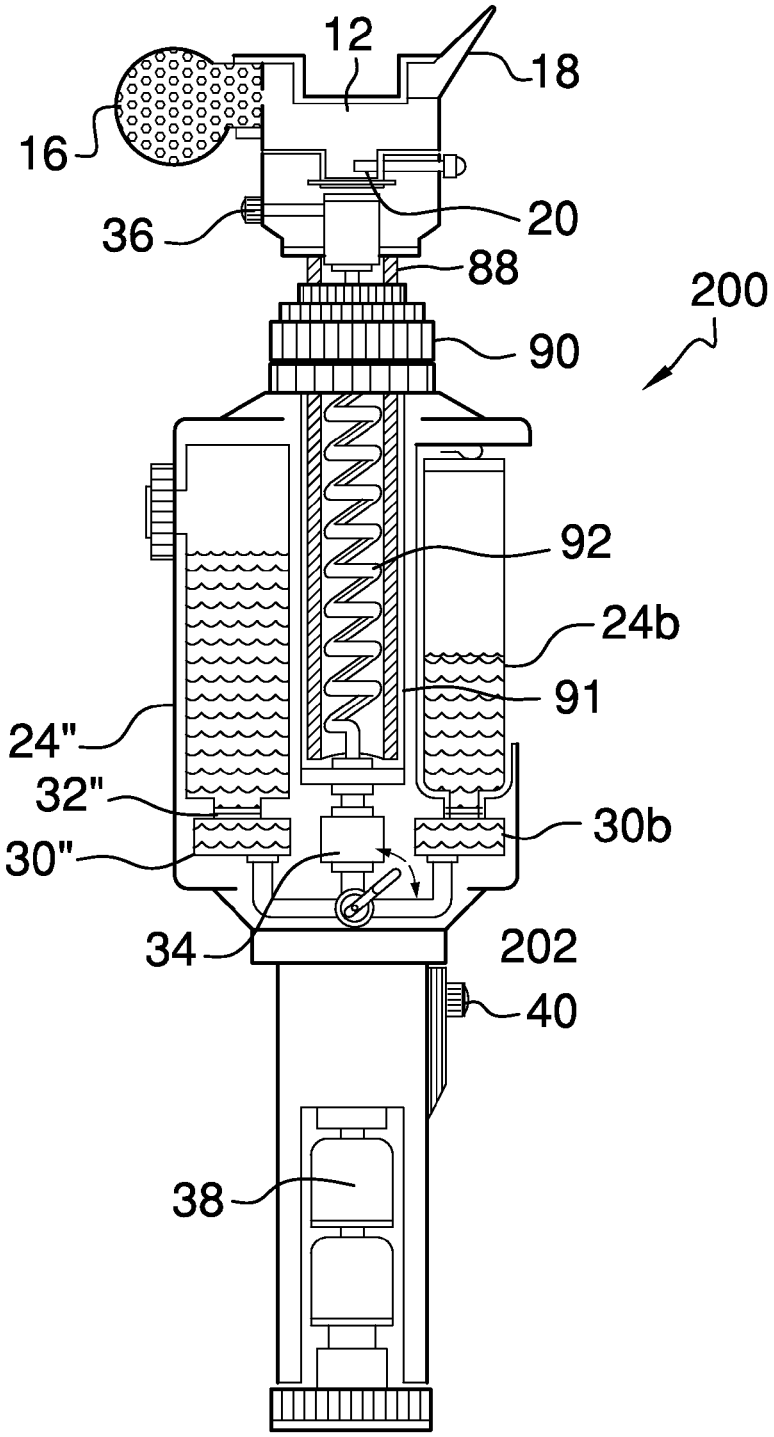
FIG. 15 is a diagrammatic illustration of the device of FIG. 1 having yet another an alternative construction including a dual container arrangement, one of the container being integral and the other being removable.

In FIG. 15, there is diagrammatically shown an alternative construction of the device 200, wherein like reference numbers refer to the same parts. Here, one of the removable containers, such as 24*a* is substituted for the integral container system of either FIG. 9 or 10.

Figure 16:
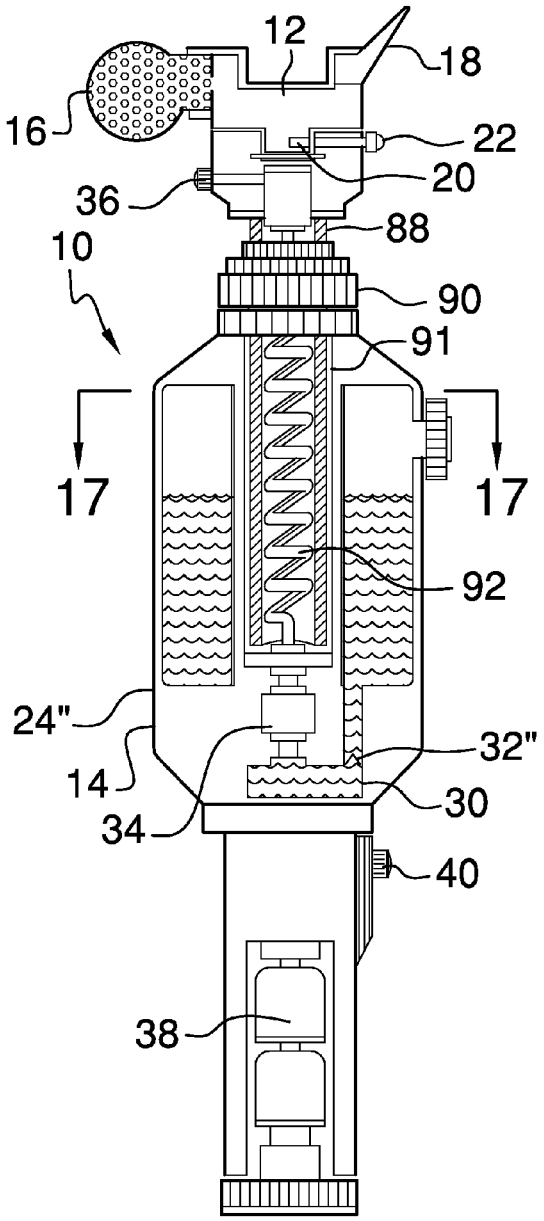
FIG. 16 is a diagrammatic illustration of the device of FIG. 1 having yet another an alternative construction.
Figure 17:
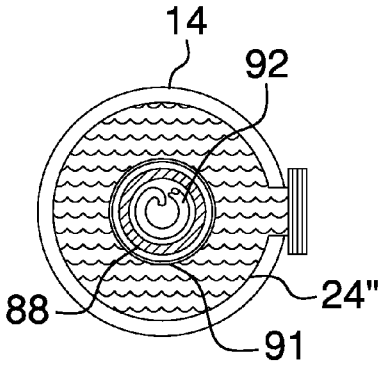
FIG. 17 is a diagrammatic illustration of the device of FIG. 16 taken along line 17-17.

In FIGS. 16 and 17, there is diagrammatically shown an alternative construction of the device 10 of FIG. 13, wherein like reference numbers refer to the same parts. Here, the integrated container 24" is cylindrical-shaped with the extension tube 88 and tubular cavity 91 encircled by the container 24".

Figure 18:
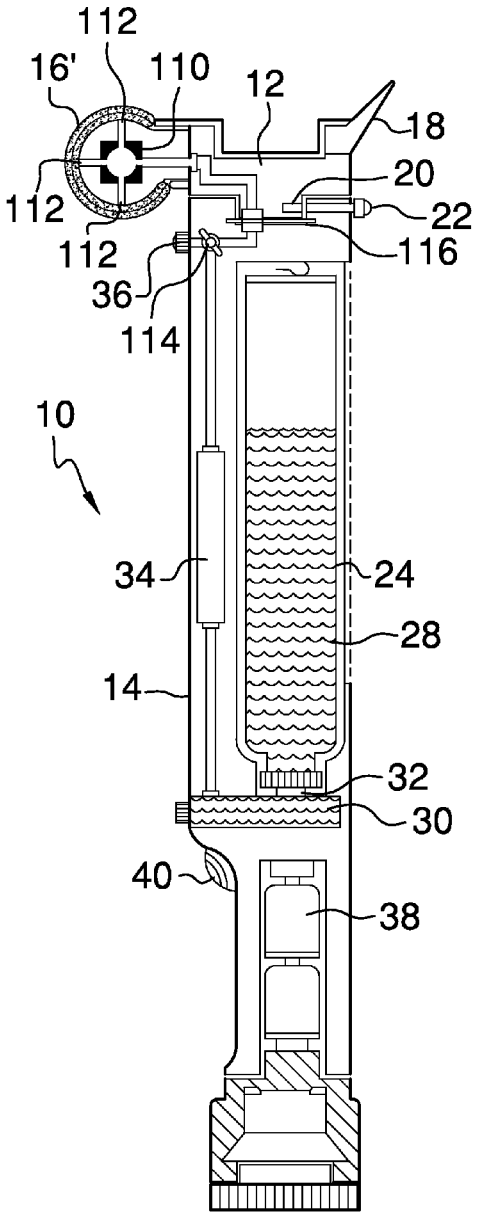
FIG. 18 is a diagrammatic illustration of the device of FIG. 1 having yet another an alternative construction having an alternative cleaning member.

In FIG. 18, there is diagrammatically shown yet another alternative construction of the device 10 of FIG. 1, wherein like reference numbers refer to the same parts. Here, the device includes a cleaning member 16' having a nozzle assembly 110 that can comprise a plurality of discharge outlets 112 arranged radially around the cleaning member and/or across the length of the cleaning member. The nozzle assembly 110 is fluidically connected to a selector valve 114 by a flexible coupling 116 which permits the cleaning head 12 to rotate between the first and second positions about coupling 20. The selector valve 114 operates to selectively and fluidically connect either nozzle 36 or nozzle assembly 110 to the pump 34.

Figure 19:
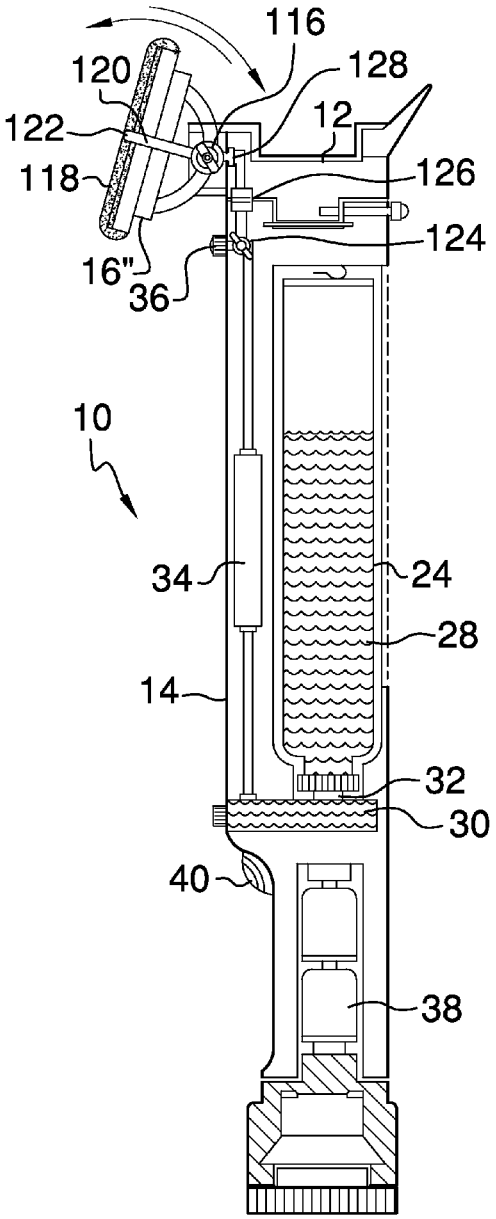
FIG. 19 is a diagrammatic illustration of the device of FIG. 1 having yet another an alternative construction having an alternative cleaning member.

In FIG. 19, there is diagrammatically shown yet another alternative construction of the device 10 of FIG. 1, wherein like reference numbers refer to the same parts. Here the device 10 includes a cleaning member 16" that is pivotally connected to the cleaning head 12 by lockable pivot coupling 116 that enables an operator to adjust and lock the angular position of the planar cleaning surface 118 of the cleaning member 16". In an aspect, the cleaning member 16" may be adjusted such that the planar cleaning surface 118 is positioned horizontally with respect to the handle 14, thereby permitting the operator to clean a ceiling surface. The cleaning member 16" may include a nozzle assembly 120 that can comprise a plurality of discharge outlets 122 arranged across the length of the cleaning member. The nozzle assembly 120 is fluidically connected to a selector valve 124 by a flexible coupling 126 which permits the cleaning head 12 to rotate between the first and second positions about coupling 20. The selector valve 124 operates to selectively and fluidically connect either nozzle 36 or nozzle assembly 120 to the pump 34. Further, the pivot coupling 116 can include a pivotal or flexible fluid joint 128.

Figure 20:
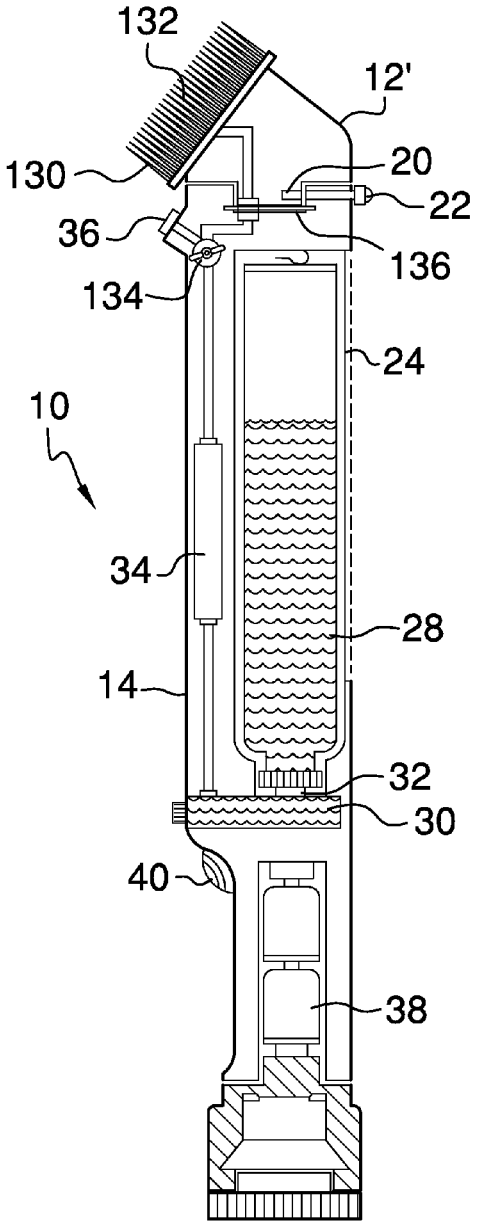
FIG. 20 is a diagrammatic illustration of the device of FIG. 1 having yet another an alternative construction having an alternative cleaning head.

In FIG. 20, there is diagrammatically shown yet another alternative construction of the device 10 of FIG. 1, wherein like reference numbers refer to the same parts. Here the device 10 includes cleaning head 12' including a bristle brush 130 and a spray outlet 132 arranged to dispense cleaning solution through the bristle brush. The spray outlet 132 is fluidically connected to a selector valve 134 by flexible coupling 136 which permits the cleaning head 12' to rotate between the first and second positions about coupling 20. The selector valve 134 operates to selectively and fluidically connect either nozzle 36 or spray outlet 132 to the pump 34.

Figure 21:
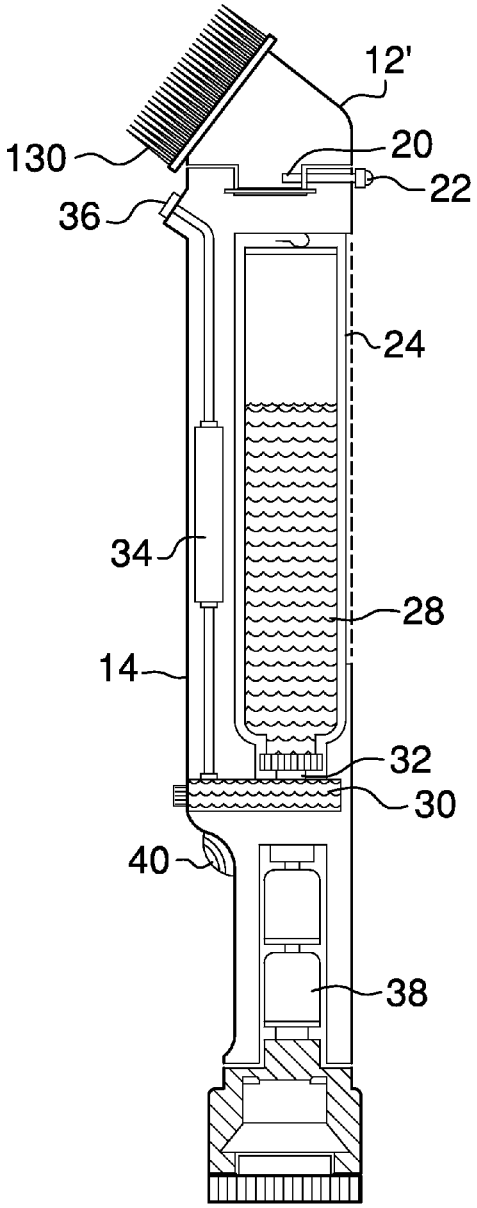
FIG. 21 is a diagrammatic illustration of the device of FIG. 1 having yet another an alternative construction having an alternative cleaning head.

In FIG. 21, there is diagrammatically shown yet another alternative construction of the device 10 of FIG. 1, wherein like reference numbers refer to the same parts. Here, device 10 is the device of FIG. 20 without the spray outlet 132, the selector valve 134 and flexible coupling 136.

Figure 22:
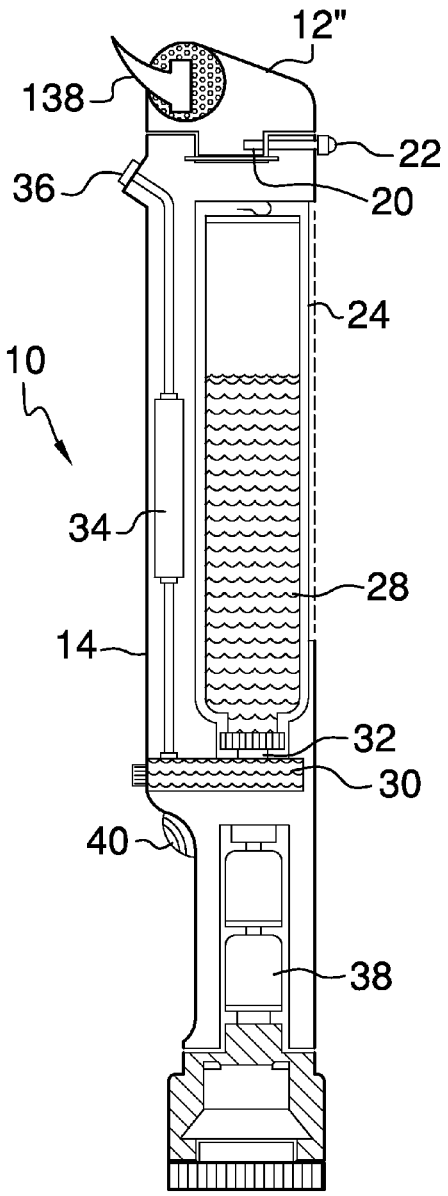
FIG. 22 is a diagrammatic illustration of the device of FIG. 1 having yet another an alternative construction having an alternative cleaning head.

In FIG. 22, there is diagrammatically shown yet another alternative construction of the device 10 of FIG. 1, wherein like reference numbers refer to the same parts. Here, device 10 includes a cleaning head 12" including a only a squeegee blade 138.

Figure 23:
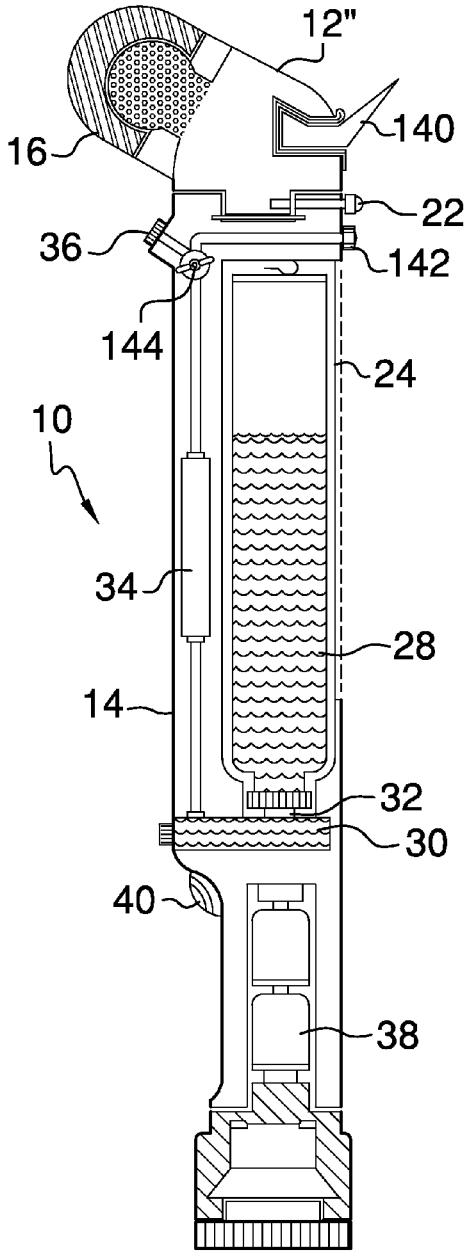
FIG. 23 is a diagrammatic illustration of the device of FIG. 1 having yet another an alternative construction having an alternative cleaning head.

In FIG. 23, there is diagrammatically shown yet another alternative construction of the device of FIG. 1, wherein like reference numbers refer to the same parts. Here, device 10 includes a cleaning head 12''' including an interchangeable cleaning implement 140 that depicted as a squeegee blade. Cleaning implement is removably secured to the cleaning head 12''' and can be interchange with several different cleaning implement types, such as, but not limited to squeegee blades, scraper blades, scrubbing implements, etc. Further, the device include a second spray nozzle 142 positioned on an opposite side of the handle 14 from spray nozzle 36. A selector valve 144 operates to selectively and fluidically connect either nozzle 36 or nozzle 142 to the pump 34.

Figure 24:
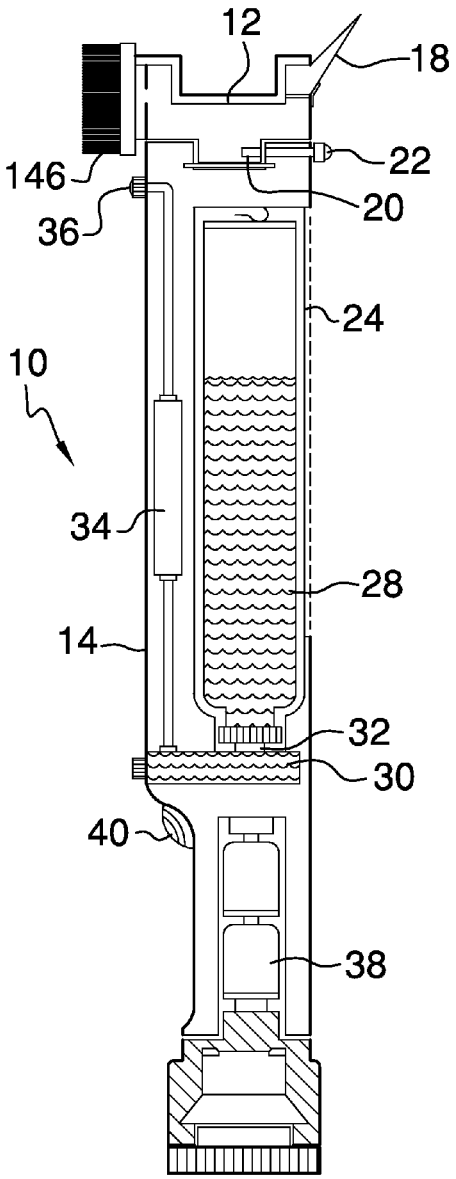
FIG. 24 is a diagrammatic illustration of the device of FIG. 1 having yet another an alternative construction having an alternative cleaning member.

In FIG. 24, there is diagrammatically shown yet another alternative construction of the device 10 of FIG. 1, wherein like reference numbers refer to the same parts. Here, device 10 includes an alternative cleaning member 146 in the form of a bristle brush.

Figure 25:
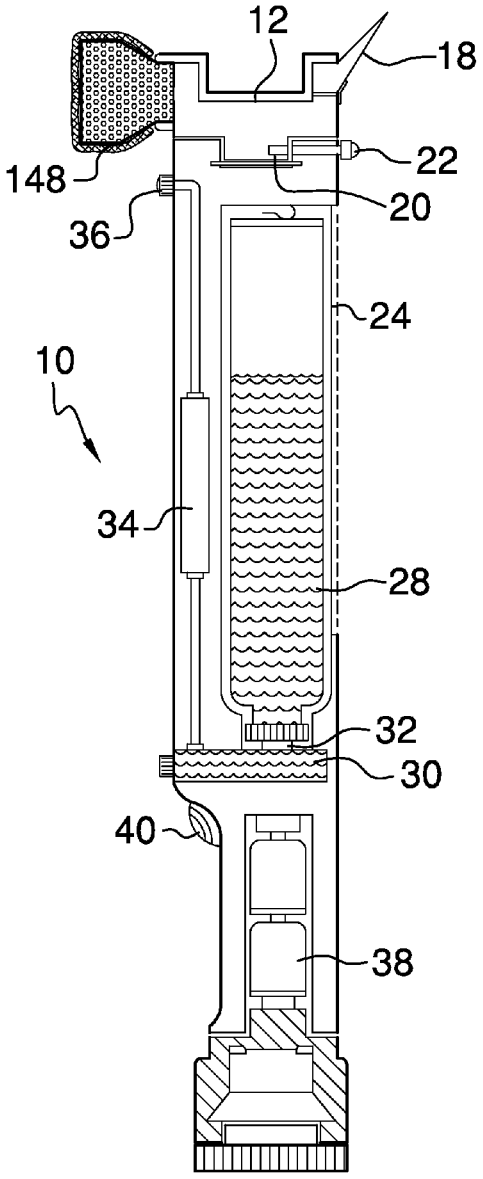
FIG. 25 is a diagrammatic illustration of the device of FIG. 1 having yet another an alternative construction having an alternative cleaning member.

In FIG. 25, there is diagrammatically shown yet another alternative construction of the device of FIG. 1, wherein like reference numbers refer to the same parts. Here, device 10 includes an alternative cleaning member 148 in the form of a sponge or like absorbent material.

Figure 26:
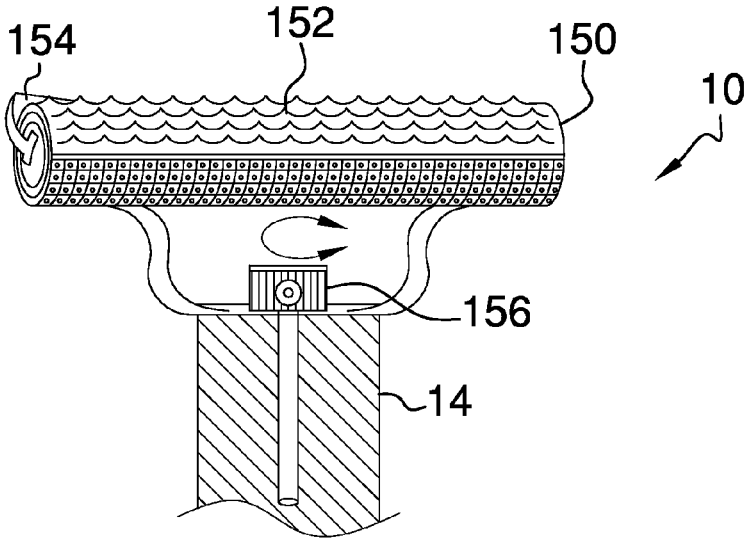
FIG. 26 is a diagrammatic illustration of the device of FIG. 1 having yet another an alternative construction having an alternative cleaning head.
Figure 27:
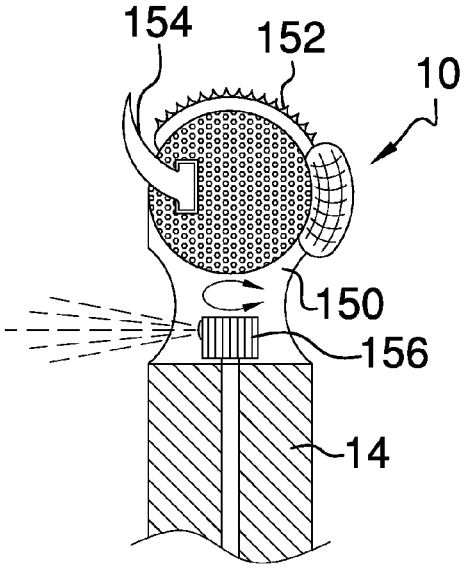
FIG. 27 is a diagrammatic illustration of the device of FIG. 26 having a spray nozzle in a first position.
Figure 28:
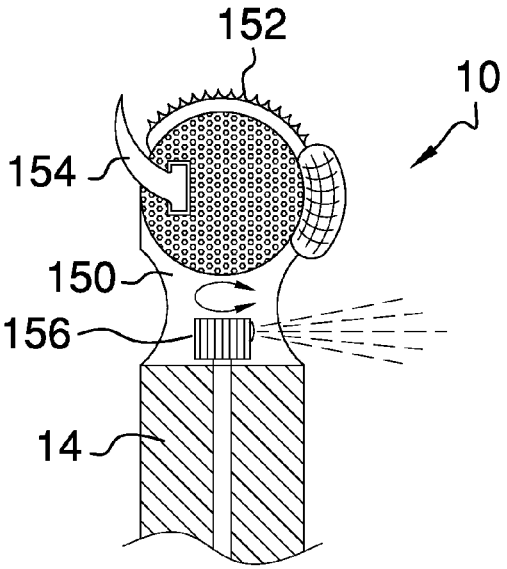
FIG. 28 is a diagrammatic illustration of the device of FIG. 26 having a spray nozzle in a second position.

In FIGS. 26-28, there is diagrammatically shown yet another alternative construction of the device of FIG. 1, wherein like reference numbers refer to the same parts. Here, device 10 includes an alternative cleaning head 150 including a removable scrubber or absorbent 152 and a squeegee blade 154 centrally disposed along the length of the scrubber 152. Further included is a rotatable spray nozzle 156 that is fluidically connected to pump 34 (not shown). Spray nozzle 156 is shown in a forward position in FIG. 27 and a rearward position in FIG. 28. Spray nozzle 156 may be locked in either position.

Figure 29:
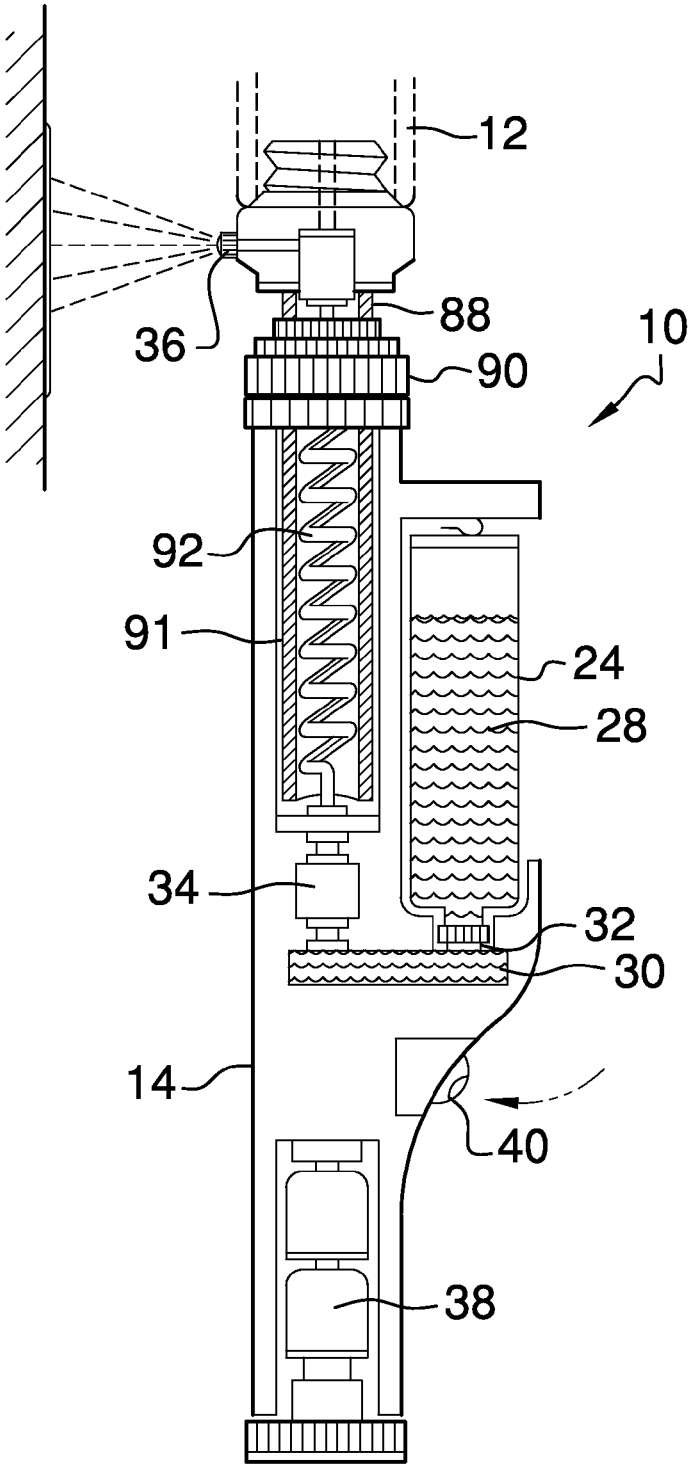
FIG. 29 is a diagrammatic illustration of the device of FIG. 1 having yet another an alternative construction.
Figure 30:
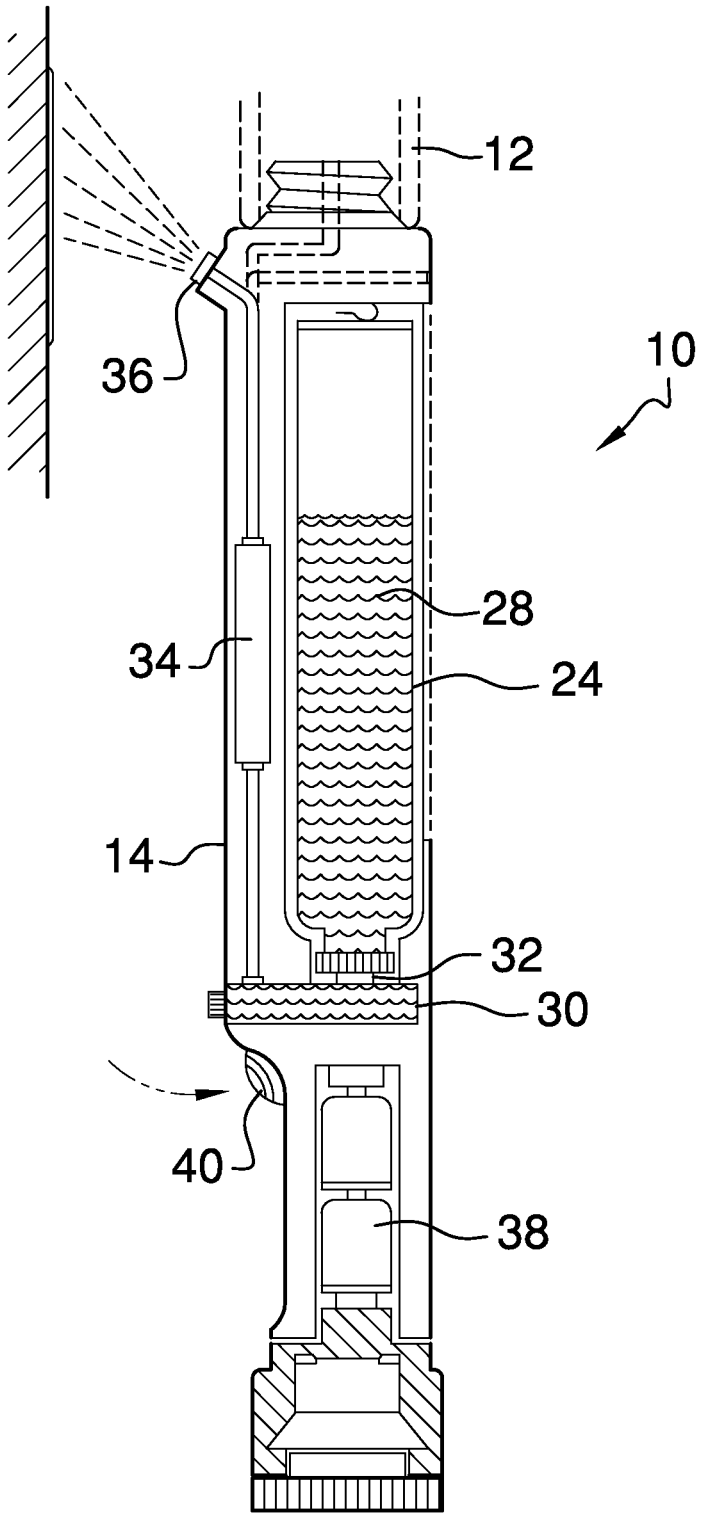
FIG. 30 is a diagrammatic illustration of the device of FIG. 1 having yet another alternative construction.

In FIGS. 29 and 30, there is diagrammatically shown yet another alternative construction of the device 10 of FIG. 1, wherein like reference numbers refer to the same parts. Here, the devices of FIGS. 29 and 30 could be removably or permanently affixed to one of any of the cleaning head types described above to form numerous combinations of devices. The purpose of FIGS. 29 and 30 is to further illustrate the versatility of the device of the invention in that while a reasonable number of combinations of the device are described above, the device could take on various other combinations of the structures disclosed herein and similar alternative structures.

A number of embodiments of the present invention have been described. Nevertheless, it will be understood that various modifications may be made without departing from the spirit and scope of the invention.

The invention claimed is:

1. A cleaning device, comprising:

a handle having opposite first and second ends, said handling have an upright orientation where said first end is disposed vertically above said second end and an inverted position where said first end is disposed vertically below said second end;

a cleaning head connected to said first end of said handle;

a container having a mouth, said container removably received and retained by said handle with said mouth facing in a direction toward said second end of said handle;

a spray nozzle carried by said handle at a position approximate said first end thereof;

a fluid accumulator housed by said handle and fluidically connected to said mouth of said container and receiving and holding a quantity of fluid contained by said container in a one-way flow in a direction from said container to said fluid accumulator;

an electric pump carried by said handle, electric pump fluidically connected to said fluid accumulator and said spray nozzle and operating to pump fluid from said fluid accumulator and through said spray nozzle;

a power source carried by said handle; and an electric switch carried by said handle and operatively connected to said power source and said electric pump, said switch operable to connect said power source and said electric pump.

2. A cleaning device, comprising:

a cleaning head;

an elongated handle configured to be grasped by a user, said handle having a first end connected to said cleaning head and a second end configured to be connected to an extension handle, said handle further configured to removably receive and retain a container in a fixed relation to said handle;

a spray nozzle carried by said handle at a position approximate said first end thereof;

a fluid accumulator housed by said handle and adapted to be fluidically connected to a container received and retained by said handle to receive and hold a quantity of fluid contained by said container in a single one-way flow in a direction from said container to said fluid accumulator;

an electric pump carried by said handle, electric pump fluidically connected to said fluid accumulator and said spray nozzle and operating to pump fluid from said fluid accumulator and through said spray nozzle;

a power source carried by said handle;

an electric switch carried by said handle and operatively connected to said power source and said electric pump, said switch operable to connect said power source and said electric pump;

a receiver carried by said handle and operably connected to said electric pump and said power source and operating upon receiving a control signal to connect said electric pump and said power source;

an extension handle connectable to said second end of said handle;

a transmitter configured to generate and transmit said control signal;

a secondary power source operatively connected to said transmitter;

a secondary electric switch operatively connected to said transmitter and operable to cause said transmitter to generate and transmit said control signal; and wherein said transmitter, said secondary power source and said secondary electric switch are attached to said extension handle.

3. The device of claim 2, wherein said handle is configured to receive a container with a mouth of the container oriented in a direction towards said second end of said handle.

4. The device of claim 2, further comprising:

a second spray nozzle; and a spray nozzle selector valve fluidically connected to said electric pump, said spray nozzle and said second spray nozzle, said spray nozzle selector valve operable to selectively connect either said spray nozzle or said second spray nozzle to said electric pump.

5. The device of claim 4, wherein said second spray nozzle is disposed on an opposite side of said handle from said spray nozzle.

6. The device of claim 2, wherein said cleaning head is pivotally connected to said first end of said handle.

7. The device of claim 2, wherein said cleaning head includes a cleaning implement and a squeegee blade positioned on opposite sides of said cleaning head.

8. The device of claim 2, further comprising:

a band removably attached to said extension hand, said transmitter, said secondary power source and said secondary electric switch are carried by said band and are removably attached to said extension handle by said band.

9. The device of claim 8, wherein said handle is configured to receive a container with a mouth of the container oriented in a direction towards said second end of said handle.

10. The device of claim 2, further comprising:

an extension handle connectable to said second end of said handle;

a secondary electric switch carried by said extension handle and being operatively connected to said power source and said electric motor when said extension handle is connected to said second end of said handle, said secondary electric switch operable to connect said power source and said electric pump.

11. The device of claim 10, wherein said handle is configured to receive a container with a mouth of the container oriented in a direction towards said second end of said handle.

12. The device of claim 10, further comprising:

a second spray nozzle; and a spray nozzle selector valve fluidically connected to said electric pump, said spray nozzle and said second spray nozzle, said spray nozzle selector valve operable to selectively connect either said spray nozzle or said second spray nozzle to said electric pump.

13. The device of claim 12, wherein said second spray nozzle is disposed on an opposite side of said handle from said spray nozzle.

14. The device of claim 10, wherein said cleaning head is pivotally connected to said first end of said handle.

15. The device of claim 10, wherein said cleaning head includes a cleaning implement and a squeegee blade positioned on opposite sides of said cleaning head.

16. The device of claim 10, further comprising:

a receiver carried by said handle and operably connected to said electric pump and said power source and operating upon receiving a control signal to connect said electric pump and said power source;

an extension handle connectable to said second end of said handle;

a transmitter configured to generate and transmit said control signal;

a secondary power source operatively connected to said transmitter;

a secondary electric switch operatively connected to said transmitter and operable to cause said transmitter to generate and transmit said control signal; and wherein said transmitter, said secondary power source and said secondary electric switch are attached to said extension handle.

17. The device of claim 16, further comprising:

a band removably attached to said extension hand, said transmitter, said secondary power source and said secondary electric switch are carried by said band and are removably attached to said extension handle by said band.

18. The device of claim 16, wherein said handle is configured to receive a container with a mouth of the container oriented in a direction towards said second end of said handle.

19. The device of claim 16, wherein said cleaning head is pivotally connected to said extension tube.

20. The device of claim 16, wherein said cleaning includes a cleaning implement and a squeegee blade positioned on opposite sides of said cleaning head.

21. The device of claim 16, further comprising:

a coiled tubing connecting said pump and said spray nozzle.

22. The device of claim 21, wherein said coiled tubing extends through said extension tube.

23. A cleaning device, comprising:

a cleaning head;

an extension tube connected to said cleaning head;

an elongated handle configured to be grasped by a user, said handle having a first end through which extends a tubular cavity into which said extension tube is telescopically received for positioning between retracted and extended positions, said handle further having a second end configured to be connected to an extension handle, said handle further configured to removably receive and retain a container in a fixed relation to said handle;

a spray nozzle carried by said extension tube;

a fluid accumulator housed by said handle and fluidically connected to a container received and retained by said handle to receive and hold a quantity of fluid contained by said container in a one-way flow in a direction from said container to said fluid accumulator;

an electric pump carried by said handle, electric pump connected to said fluid accumulator and said spray nozzle and operating to pump fluid from said fluid accumulator and through said spray nozzle;

a power source carried by said handle;

an electric switch carried by said handle and operatively connected to said power source and said electric pump, said switch operable to connect said power source and said electric motor;

an extension handle connectable to said second end of said handle; and a secondary electric switch carried by said extension handle and being operatively connected to said power source and said electric motor when said extension handle is connected to said second end of said handle, said secondary electric switch operable to connect said power source and said electric pump.

24. The device of claim 23, wherein said handle is configured to receive a container with a mouth of the container oriented in a direction towards said second end of said handle.

25. The device of claim 23, wherein said cleaning head is pivotally connected to said extension tube.

26. The device of claim 23, wherein said cleaning head includes a cleaning implement and a squeegee blade positioned on opposite sides of said cleaning head.

27. The device of claim 23, further comprising:

a coiled tubing connecting said pump and said spray nozzle.

28. The device of claim 27, wherein said coiled tubing extends through said extension tube.

29. The device of claim 23, wherein said handle is configured to receive a container with a mouth of the container oriented in a direction towards said second end of said handle.

30. The device of claim 23, wherein said cleaning head is pivotally connected to said extension tube.

31. The device of claim 23, wherein said cleaning includes a cleaning implement and a squeegee blade positioned on opposite sides of said cleaning head.

32. The device of claim 23, further comprising:

a coiled tubing connecting said pump and said spray nozzle.

33. The device of claim 32, wherein said coiled tubing extends through said extension tube.

* * * * *